US006612937B1

(12) United States Patent
Whelan

(10) Patent No.: US 6,612,937 B1
(45) Date of Patent: Sep. 2, 2003

(54) GOLF SWING SWAY INDICATOR AND TRAINER

(76) Inventor: Michael Whelan, 30469 Rockshire Ave., Farmington Hills, MI (US) 48334-4628

( * ) Notice: Subject to any disclaimer, the term of this patent is extended or adjusted under 35 U.S.C. 154(b) by 0 days.

(21) Appl. No.: 09/516,875

(22) Filed: Mar. 1, 2000

Related U.S. Application Data

(60) Provisional application No. 60/122,301, filed on Mar. 1, 1999.

(51) Int. Cl.[7] ..... A63B 53/06; A63B 53/16; A63B 69/36; A63B 57/00

(52) U.S. Cl. ..... 473/268; 473/266; 473/219

(58) Field of Search ..... 473/266, 267, 473/268, 269, 152, 153, 154, 155, 156, 198, 199, 221, 222, 467; 273/348, DIG. 28, 108.2, 371; 340/323 R; 40/564, 581; 434/247, 252; 33/245, 246, 248, 251, 280, 298; 356/123, 375, 420

(56) References Cited

U.S. PATENT DOCUMENTS

| | | | | | |
|---|---|---|---|---|---|
| 3,000,261 | A | * | 9/1961 | Fremkel | 473/268 |
| 3,256,014 | A | * | 6/1966 | Kelsey | 40/564 |
| 3,524,650 | A | * | 8/1970 | Brandell | 473/268 |
| 3,666,936 | A | * | 5/1972 | Webster, Jr. et al. | 40/564 |
| 3,806,722 | A | * | 4/1974 | Peake et al. | 40/564 |
| 4,032,157 | A | * | 6/1977 | Carpenter | 473/268 |
| 4,143,877 | A | * | 3/1979 | Jeffries | 473/268 |
| 4,483,536 | A | * | 11/1984 | Mitchell | 473/268 |
| 4,963,314 | A | * | 10/1990 | Gering et al. | 473/268 |
| 5,330,191 | A | * | 7/1994 | Hoganson | 362/257 |
| 5,338,037 | A | * | 8/1994 | Toyohara | 473/268 |
| 5,409,232 | A | * | 4/1995 | Hoganson | 473/268 |
| 5,577,916 | A | * | 11/1996 | Gordon | 473/252 |
| 5,599,239 | A | * | 2/1997 | Kim et al. | 473/208 |
| 5,624,327 | A | * | 4/1997 | Smith | 473/268 |
| 6,095,928 | A | * | 8/2000 | Goszyk | 473/222 |
| 6,261,189 | B1 | * | 7/2001 | Saville et al. | 473/221 |

OTHER PUBLICATIONS

Merriam's Webster's Collegiate Dictionary (www.m–w.com).*

Halliday, David et al., Fundamentals of Physics, 4th Edition, New York: John Wiley & Sons, Inc., Copyright 1993, p. 1026.*

Internet advertisement for Plane Sight Laser, Plane Sight Inc., Jun. 7, 1999.

Internet advertisement for EZ Plane Swing Trainer.

Internet advertisement for Bushnell Laser Practice Pro.

Internet advertisement for Balance Enforcer.

* cited by examiner

*Primary Examiner*—Paul T. Sewell
*Assistant Examiner*—Alvin A. Hunter, Jr.
(74) *Attorney, Agent, or Firm*—Gifford, Krass, Groh, Sprinkle, Anderson & Citkowski, P.C.

(57) ABSTRACT

A golf swing training apparatus includes a base that has a top surface in which is defined a slot. A cover is movably mounted on the base and includes a top surface upon which is defined a second slot. The second slot of the cover is vertically aligned with the first slot of the base when the cover is mounted on the base. A light source is positioned in the base and transmits light through the first and second slots toward the eyes of a user. A number of color strips are positioned within the first slot such that the color of light witnessed by the user will vary depending upon the lateral position of the user's head relative to the center line of the second slot.

20 Claims, 3 Drawing Sheets

GOLF SWING SWAY INDICATOR AND TRAINER

CROSS-REFERENCE TO RELATED APPLICATION

This application claims the benefit of United States Provisional Application having Serial No. 60/122,301 filed Mar. 1, 1999.

BACKGROUND OF THE INVENTION

1. Field of the Invention

The present invention relates generally to a device for use in training and practicing for the game of golf. More specifically, the present invention is directed to an apparatus that assists in the control of head and body position during a golf swing.

2. Description of the Art

Balance and proper weight is fundamental to maintaining consistency and power in a golf swing. Lateral movement of the body to the left or right from a center pivot position will distort the simple arc of a golf club swing and force a player to make physical-corrections in that swing in order to make proper contact with the golf ball. However, the player's attempt to physically correct his or her swing typically results in further complications of the swing motion that increases the possibility of errors and inconsistencies throughout the golf swing. A lateral sway away from a centered position may also result in an "incomplete" swing that is slow and underpowered.

A perfectly centered golf swing (i.e. a swing devoid of lateral sway) is characterized by little or no lateral motion of the head and torso throughout the entire swing. Presently, a number of products are available that assist the golfer in controlling lateral sway and thus assist the golfer in obtaining the perfect centered golf swing. However, many of these products must be affixed directly on the club or the player. For example, one such product includes a laser that is aimed at the golf ball and affixed to a cap worn on the player's head. These prior art devices have several obvious disadvantages. Devices directly affixed to the golf club may distort the player's swing due to the added weight of the device on the club. Furthermore, a player that practices with such a device will have to compensate for the absence of the device and its weight when out on the golf course. Devices affixed to the player also contribute to swing error. These devices may be uncomfortable or otherwise interfere with the golfer's normal swing. Alternatively, the golfer may adjust his or her swing in order to adapt to the use of the device only to have their swing further deteriorate on the golf course where such a device would not be permitted under USGA rules.

SUMMARY OF THE INVENTION

The present invention is designed to allow a player to control lateral sway while allowing complete freedom of movement, requiring no attachment to the users or the club. Preferably, the present invention is an apparatus which emits bands of light to indicate the golfer's position with respect to a center position. The apparatus includes a base, the base including a opening defined in its top. A cover is disposable over the base unit and includes a second opening alignable along a vertical axis with the first opening when the cover is disposed on the base. The base also comprises a lower chamber containing a light source. Preferably, a transparent film is disposed within the opening of the base. The film includes a center strip that is green in color which is flanked on opposite sides by a red colored film The light source projects a beam of light through the first and second openings towards the player's eyes. The width of the center opening is determined based upon geometric calculations such that when the golfer is on center he or she sees only the green stripe. However, when the golfer sways laterally to the left or to the right, he or she will see the red stripe. The cover is vertically slideable on the base unit such that the distance between the openings may be easily adjusted by the user. Adjustment of the opening distance widens or narrows the allowable sway tolerance under the device and allows the user to customize the device in order to provide customized feedback to the player regarding their lateral sway from the center position.

BRIEF DESCRIPTION OF THE DRAWINGS

The present invention is better understood by reference to the accompanying drawings that are representative of the invention but not intended to limit the scope of the claims.

DETAILED DESCRIPTION OF THE PREFERRED EMBODIMENT

Figure 1:
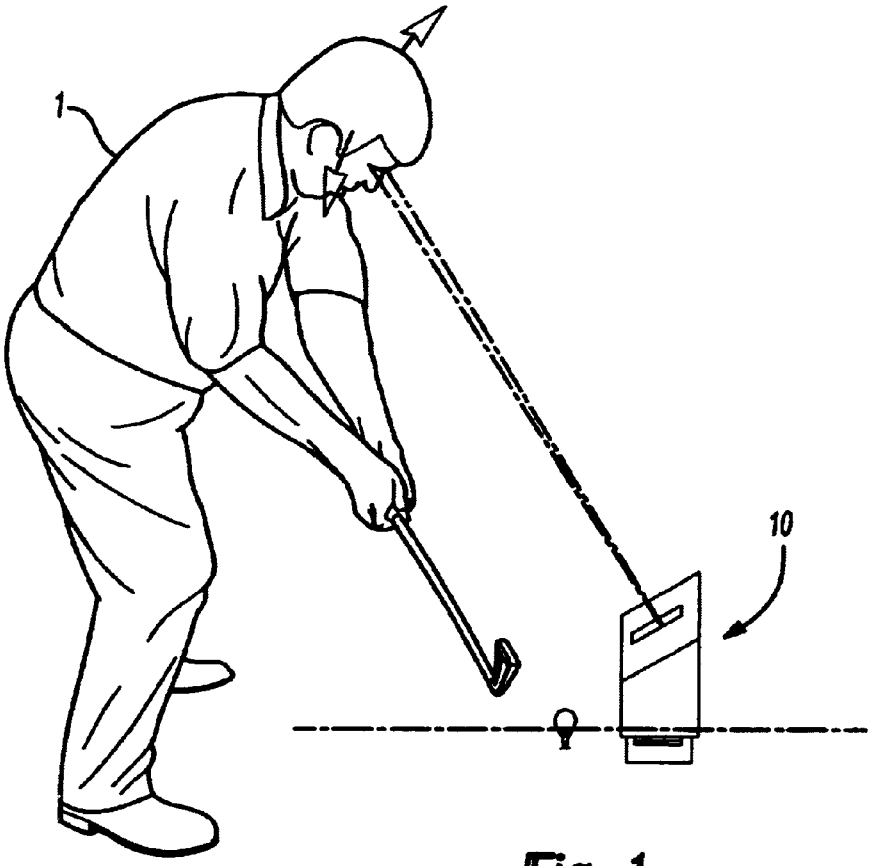
FIG. 1 is a perspective view of an apparatus constructed in accordance with a first preferred embodiment of the present invention in use by a golfer.

The present invention relates to an apparatus 10 for enabling a golfer 1 to determine his position relative to the ball while swinging. The apparatus 10 preferably comprising: a base 12 having a top surface 18 defining with a first opening 30; a cover 14 is removably mounted on the base 12 and also has a top surface 26 defining a second opening 32 vertically aligned with the first opening 30; a light source 16 disposed in the base for transmitting light upwardly though the openings 30, 32 and toward the golfer 1 and; the light source 16 and openings 30, 32 producing bands of light for indicating the amount of lateral distance the golfer has swayed from a center position with respect to the apparatus 10.

Referring now to FIG. 1, there is shown a preferred embodiment of the present invention in use by a golfer 1. Preferably, the present invention is placed on the ground at a distance away from the golfer along a plane extending from the golfer through the golf tee.

Figure 2:
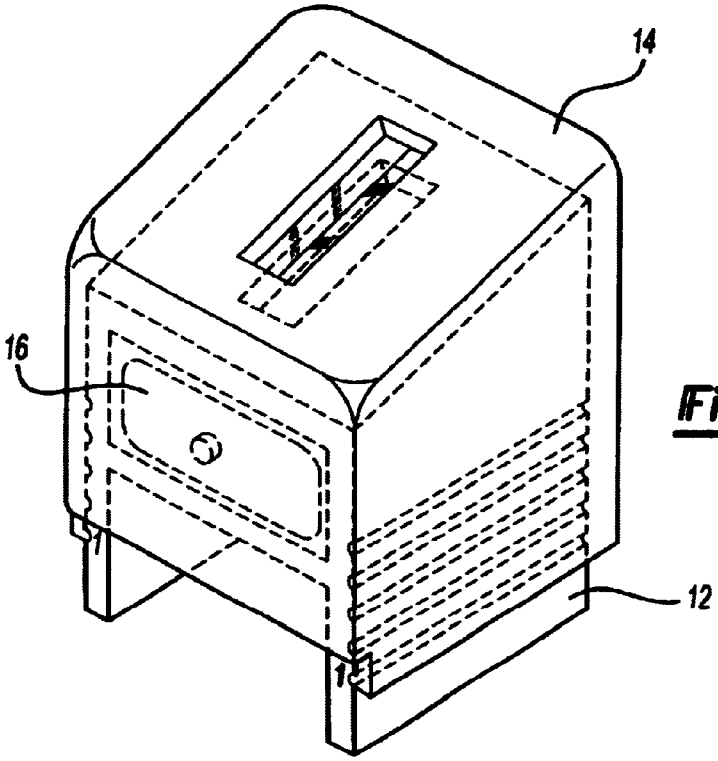
FIG. 2 is a perspective view of an apparatus constructed in accordance with a first embodiment of the invention.

Referring now to FIG. 2, the preferred embodiment of the present invention shows the apparatus 10 including the base 12 and the cover 14. The base 12 and cover 14 are preferably constructed of plastic. However, stainless steel or other well known materials possessing the requisite structural rigidity may also be utilized by the present invention.

Figure 3:
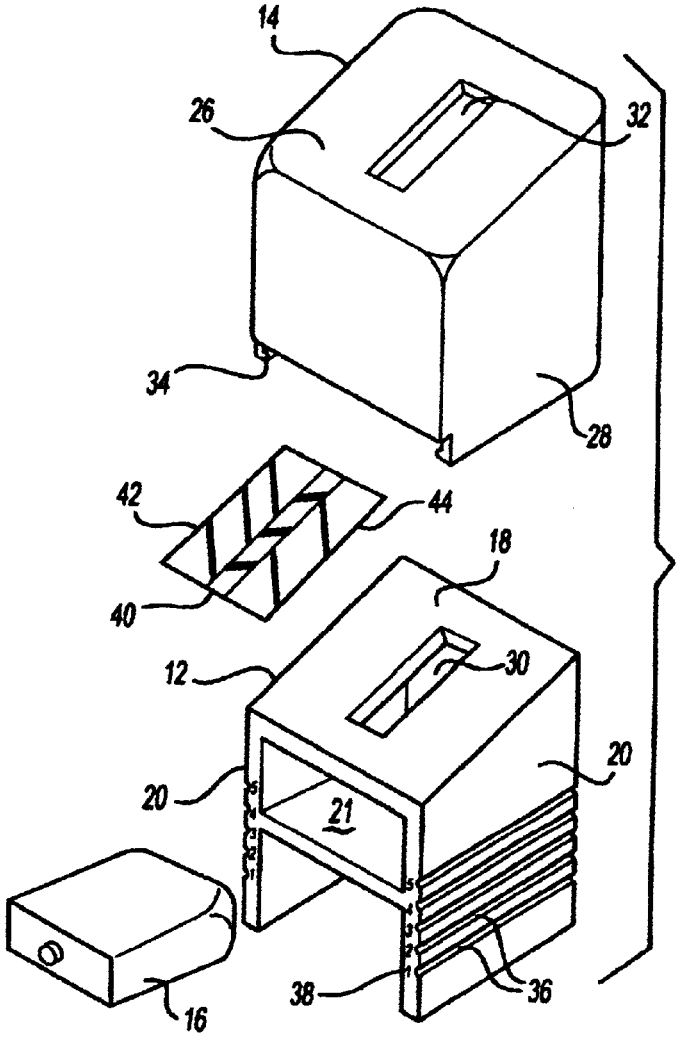
FIG. 3 is an exploded view of an apparatus constructed in accordance with a first embodiment of the invention.

As seen in FIGS. 2 and 3, the base 12 comprises the top surface 18, side walls 20 and the inner shelf 21. The top surface 18, walls 20 and shelf 21 defining a chamber 22. The top surface 18 and shelf 21 are angled upwardly so that the top surface 18 and the chamber 22 are on the plane "P" (see FIG. 4) generally orthogonal to a line between the golfer's eyes and the golf ball. The opening 30 is defined in the top surface 18 and extends through the top surface 18 to the chamber 22. Preferably, the opening 30 in the top surface is a slot.

Still referring to FIGS. 2 and 3, the cover 14 preferably includes top surface 26 and side walls 28. The side walls 28 extend downwardly from the top 26 to slidingly engage the side walls 20 of the base 12. The side walls 28 of the cover 14 further comprise bracket members 34 located on the base of each side wall 28. The brackets 34 secure the cover 14 in position on the base 12 by releasably engaging one of a series of parallel grooves 36 defined in the walls 20 of the base. As an alternative to the use of brackets 34 and grooves 36, felt pads (not shown) may be positioned on the interior (not shown) of the side walls 28 of the cover 14 to frictionally secure the cover 14 on the base 12 and permit the golfer 1 to make incremental adjustments to the position of the cover 14.

The top 26 of the cover 14 extend on the plane "P" which is parallel to the top surface 18 and the chamber 22. The second opening 32, preferably a second slot, is defined in the top surface 26 of the cover 14. Preferably, when the cover 14 is positioned upon the base 12 so that the openings 30, 32 are in vertical alignment. The spacing between the openings can be varied by sliding the cover 14 upwardly or downwardly on the base 12.

As seen in FIG. 3, a scale 38, is mounted on at least one wall 20 of the base 12 to indicate the spacing between the openings 30, 32 when the cover 14 is mounted on the base 12.

Still referring to FIGS. 2 and 3, the light source 16 is removably mounted within the chamber 22, beneath the openings 30, 32 and projects a beam of light upwardly through the openings 30, 32. Preferably, the light source is a small high-power battery powered lamp. However, the light source 14 may be of any suitable type, such as a flashlight having a battery powered bulb with reflective lens or lamp utilizing a power cord.

Mounted on the opening 30 are three colored strips 40, 42, 44. The strips 40, 42, 44 each have a predetermined width and are preferably constructed of a transparent film The center strip 40 is green in color and is flanked on either side by two red strips 42, 44. Alternatively, a variety of colored strips (e.g., red, green and white) may be used in combination.

Figure 4:
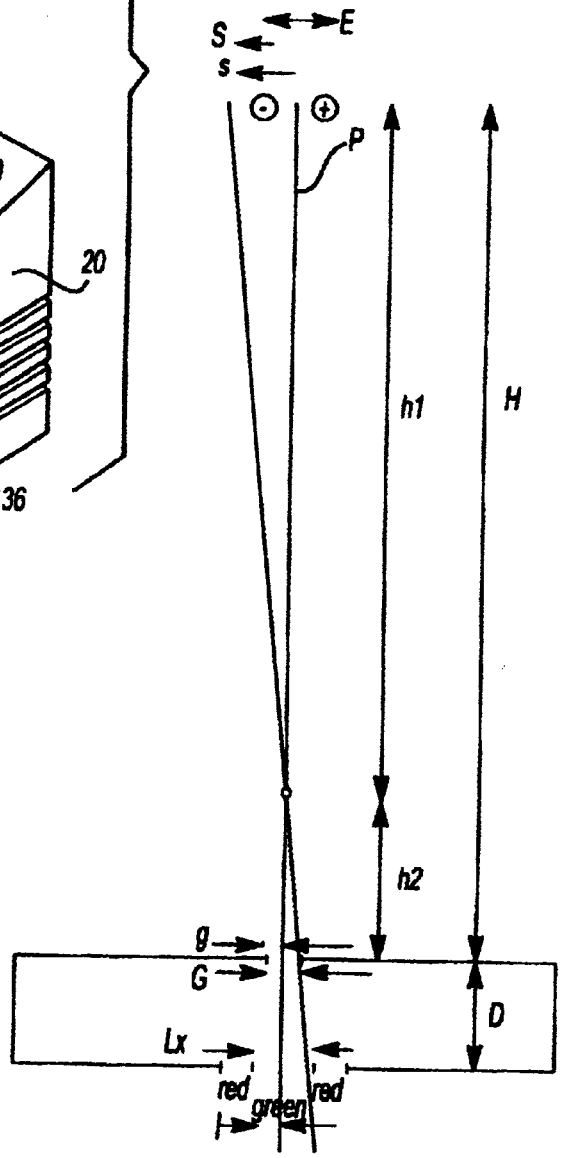
FIG. 4 is a diagrammatic view geometric measurements for use with a an apparatus constructed in accordance with a first embodiment of the invention.

As seen in FIG. 4, several variables determine the color of light the golfer will witness. These variable include: the separation of a player's eyes (E), the amount of sway (S) (i.e., the lateral deflection of the golfer from a preferred centerline with the center strip 40), distance from the eyes to the box at address (H), separation of the two planes in the box (D), the width of the gap in the top plane (G) and the width of the center color bar in the lower plane (J).

The engagement of the brackets 34 of the cover 12 with the grooves 36 of the walls 20 of the base 12 secures the cover in place on the base 12 such that the gap (G) and the color bar width (I) are constant. Adjustments to the gap (G) may be made by varying the separation (D) of the base 12 and the cover 14, to allow for more or less sway and variations in the size of the golfer 1 effecting eye separation (E) and distance from the ball and box (H).

As seen in the following calculations and tables, the width of the center color strip is determined based on geometric calculations such that when the player is on center, he or she sees only the green center strip 40. Preferred calculations and exemplary tables for use with the apparatus of the present apparatus 10 are as follows:

Wherein: (calculations shown are in inches)

s=½ E+S g=½ G h1=SH/(S+G)

h2=H−h1

L=((D+h2)/h2)G

| | | | | | | | | | |
|---|---|---|---|---|---|---|---|---|---|
| E = | 2.75 | 2.25 | 3.00 | 2.25 | 3.00 | 2.25 | 3.00 | 2.25 | 3.00 |
| S = | 1.00 | 1.00 | 1.00 | 3.00 | 3.00 | 1.00 | 1.00 | 3.00 | 3.00 |
| H = | 60.00 | 45.00 | 45.00 | 45.00 | 45.00 | 65.00 | 65.00 | 65.00 | 65.00 |
| D = | 2.00 | 1.67 | 1.43 | 0.89 | 0.81 | 2.41 | 2.07 | 1.28 | 1.17 |
| G = | 0.250 | 0.250 | 0.250 | 0.250 | 0.250 | 0.250 | 0.250 | 0.250 | 0.250 |
| s = | 2.38 | 2.13 | 2.50 | 4.13 | 4.50 | 2.13 | 2.50 | 4.13 | 4.50 |
| g = | 0.13 | 0.13 | 0.13 | 0.13 | 0.13 | 0.13 | 0.13 | 0.13 | 0.13 |
| h1 = | 57.00 | 42.50 | 42.86 | 43.68 | 43.78 | 61.39 | 61.90 | 63.09 | 63.24 |
| h2 = | 3.00 | 2.50 | 2.14 | 1.32 | 1.22 | 3.61 | 3.10 | 1.91 | 1.76 |
| L | 0.417 | 0.417 | 0.417 | 0.418 | 0.417 | 0.417 | 0.417 | 0.417 | 0.417 |
| G/L | 60% | 60% | 60% | 60% | 60% | 60% | 60% | 60% | 60% |

| | | | | | | | | | | |
|---|---|---|---|---|---|---|---|---|---|---|
| E = | 2.75 | 2.75 | 2.75 | 2.75 | 2.75 | 2.75 | 2.75 | 2.75 | 2.75 | 2.75 |
| S = | 1.00 | 1.00 | 1.25 | 1.50 | 1.75 | 2.00 | 2.25 | 2.50 | 2.75 | 3.00 |
| H = | 60.00 | 60.00 | 60.00 | 60.00 | 60.00 | 60.00 | 60.00 | 60.00 | 60.00 | 60.00 |
| D = | 2.00 | 2.00 | 1.82 | 1.67 | 1.54 | 1.43 | 1.34 | 1.25 | 1.18 | 1.11 |
| G = | 0.250 | 0.250 | 0.250 | 0.250 | 0.250 | 0.250 | 0.250 | 0.250 | 0.250 | 0.250 |
| s = | 2.38 | 2.38 | 2.63 | 2.88 | 3.13 | 3.38 | 3.63 | 3.88 | 4.13 | 4.38 |
| g = | 0.13 | 0.13 | 0.13 | 0.13 | 0.13 | 0.13 | 0.13 | 0.13 | 0.13 | 0.13 |
| h1 = | 57.00 | 57.00 | 57.27 | 57.50 | 57.69 | 57.86 | 58.00 | 58.13 | 58.24 | 58.33 |
| h2 = | 3.00 | 3.00 | 2.73 | 2.50 | 2.31 | 2.14 | 2.00 | 1.88 | 1.76 | 1.67 |
| L | 0.417 | 0.417 | 0.417 | 0.417 | 0.417 | 0.417 | 0.417 | 0.417 | 0.417 | 0.417 |
| G/L | 60% | 60% | 60% | 60% | 60% | 60% | 60% | 60% | 60% | 60% |

Preferably the golfer 1 is instructed to begin training at a (D) position in which he or she can comfortably see green throughout the entire swing, then, to slowly adjust (D) to tighten up on the amount of sway allowed in the swing. Feedback is provided on every swing; the color red is seen whenever the desired threshold for sway is exceeded.

In operation, light from the light source 16 is projected upwardly through the opening 30, strips 40, 42, 44 and opening 32 into the eyes of the golfer. Depending upon the position of the golfer's eyes relative to the apparatus 10, the cover 14 will obscure the strips 40, 42, 44 such that the golfer 1 will see the green center strip 40, a red strip 42 or 44 or a combination of strips.

Figure 5:
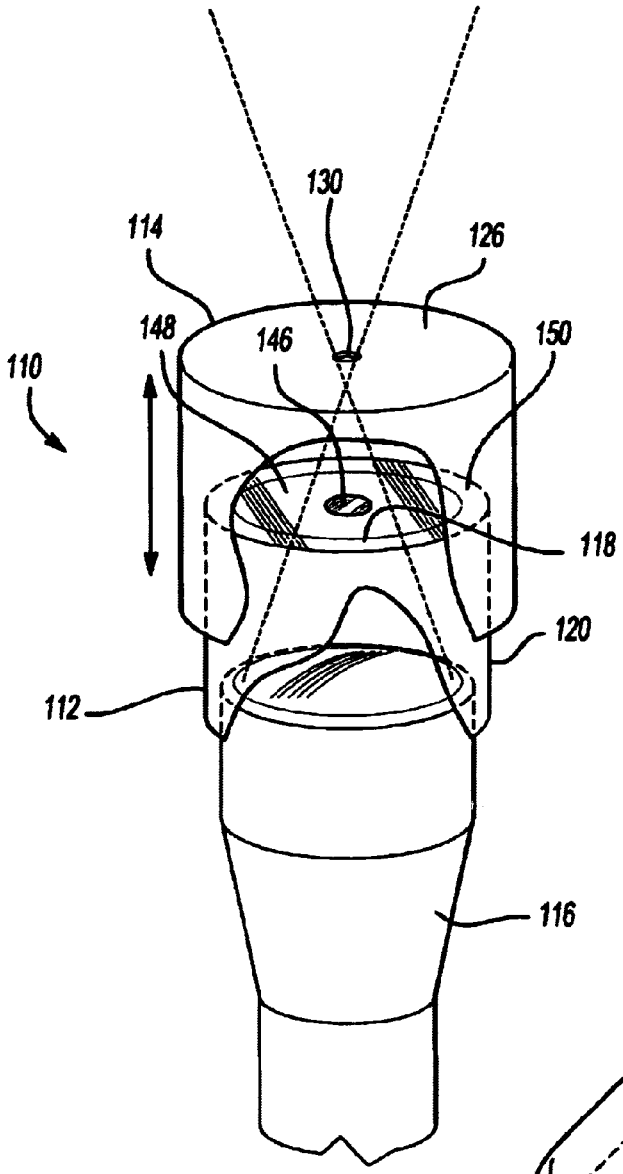
FIG. 5 is a perspective view of an apparatus constructed in accordance with a first alternative embodiment of the present invention.
Figure 6:
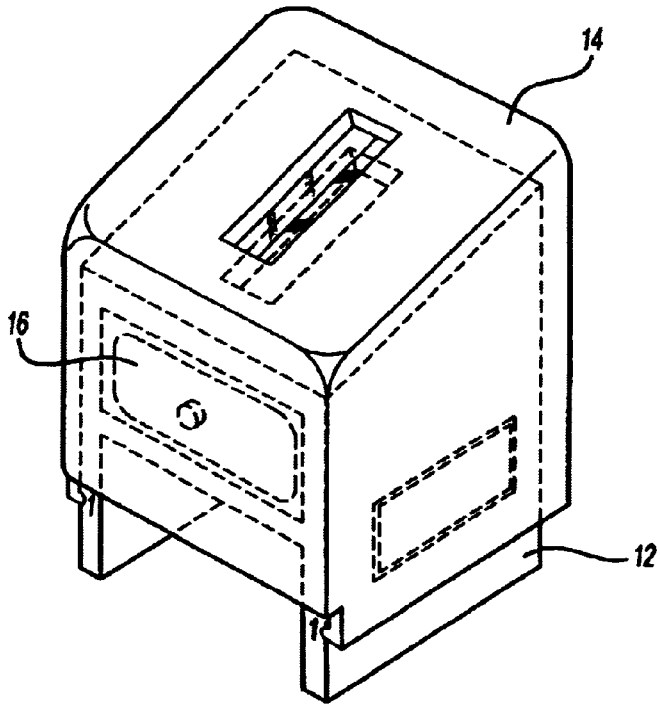
FIG. 6 is a perspective view of the apparatus of FIG. 1 using pads to frictionally hold the cover to the base.

Seen in FIG. 5 is an alternative preferred embodiment of the present invention. As seen in FIG. 5, in invention includes an apparatus 110 comprising a base 112 having a top surface 118 and a side wall 120. A cover 114 having a top 126, defining an opening 130, and a side wall is removably secured on the base 112 by side wall brackets (not shown) engagable with the grooves (not shown) of the base wall 120. The top surface 118 of the base 112 is constructed of a transparent material (such as a clear plastic) and preferably includes a center portion 46 of a first color and an middle portion 148 of a second color and an outer portion of a third color 150.

A light source 116 comprises a flashlight mounted within the base. The light source projects a light upwardly through the top surface 120 of the base 112 and through the opening 130.

Having described my invention, various modifications and improvements will be obvious to those having skill in the art that do not depart from the scope of this invention. For example, the light source and color A indicating means is an array of at least two colored lights (e.g. Christmas tree lights). Additionally, the top of the cover or the opening on the cover may be replaced with a refracting lens. As disclosed above, use of a refracting lens in place of or mounted on the cover of the apparatus 10 will permit the golfer 1 to witness a first light when the golfer 1 has a minimum or no sway away from the plane P and at least one or more lights as the golfer's 1 sways away from the plane P.

I claim:

1. A golf swing training apparatus for determining the amount of sway of a golf swing comprising:

a base having a top, said top defining an opening;

a cover mounted for reciprocal movement on said base, said cover having a top surface defining an opening, the opening of said top of said base being vertically aligned with and spaced apart a distance from said opening of said cover and said base having a scale for indicating the distance between the opening of said top of said base and said opening of said cover;

a light source mounted in the base for transmitting a light; and means for indicating the amount of sway of a golfer, said means for indicating including said opening in said top of the cover and emitting a center beam of light and at least one side beam of light through said opening in said top surface of the cover.

2. A golf swing training apparatus for use in determining the amount a golfer sways during a swing, comprising:

a base including a top having an opening;

a cover mounted for reciprocal movement on said base having an opening aligned with and separated a distance from said opening of said top, said distance of said opening of said cover from said opening of said top being increased as said cover is moved away from said top of said base and decreased as said cover is moved toward said top of said base;

a light source disposed within said base and adapted to emit a light through said openings in said cover and said top, the range of light visible to a golfer through said opening in said cover being increased or decreased as said distance of said opening of said cover from said opening of said top is increased or decreased; and a lens positioned between said base and said cover and aligned with said openings in said cover and said top, said lens having at least two colored strips such that said light is divided into a center beam of light and at least one side beam of light.

3. The golf swing training apparatus of claim 2, wherein said top of said base is angled upwardly.

4. The golf swing training apparatus of claim 2, wherein said base further comprises at least two sidewalls that extend downwardly from said top.

5. The golf swing training apparatus of claim 4, wherein said cover further comprises at least two sidewalls, each of said sidewalls of said cover being adapted to slidably engage said one of said at least two sidewalls of said base.

6. The golf swing training apparatus of claim 5, wherein at least one of said sidewalls of said cover further comprises a felt pad, said felt pad being adapted to frictionally engage a sidewall of said base.

7. The golf swing training apparatus of claim 4, wherein each of said at least two sidewalls of said top of said base further comprises a pair of parallel grooves.

8. The golf swing training apparatus of claim 7, wherein said cover further comprises at least two sidewalls that extend downwardly from a top of said cover, each of said sidewalls of said cover having a bracket adapted to engage one of said pair of parallel grooves on each of sidewalls of said base such that said cover is removably secured to said base.

9. A golf swing training apparatus for determining the amount of sway experienced by a golfer during a swing, comprising:

a base;

a cover movably mounted on said base having an opening separated a distance from said base, said distance of said opening of said cover from said base being increased as said cover is moved away from said base and decreased as said cover is moved toward said base;

a light source positioned on said base and emitting a light through said opening, the range of light visible to a golfer through said opening being increased or decreased as said distance of said opening of said cover from said base is increased or decreased; and a lens aligned with said light source and said opening, said lens having at least a first colored region and a second colored region such that said light is divided into a center beam of light and at least one side beam of light.

10. The apparatus of claim 9, wherein said light source comprises a lamp.

11. The apparatus of claim 9, wherein said light source comprises a flashlight.

12. The apparatus of claim 9, wherein said base comprises a top, said top defining an opening, said opening being vertically aligned with and spaced apart from said opening of said cover.

13. The apparatus of claim 12, further comprising means for varying the distance between the opening of said top of said base and the opening of said cover.

14. The apparatus of claim 12, wherein said base comprises a scale for indicating the distance between the opening of said top of said base and the opening of said cover.

15. The apparatus of claim 12, wherein said means for indicating comprises a transparent film mounted on said opening of said base.

16. The apparatus of claim 15, wherein said transparent film comprises at least two of colored strips.

17. The apparatus of claim 12, wherein said lens is mounted between said opening of said top of said base and said opening of said cover.

18. The apparatus of claim 9, wherein said light source comprises at least two colored lights.

19. The golf swing training apparatus of claim 9, wherein said base further comprises an upwardly angled top.

20. A golf swing training apparatus for use in determining the amount a golfer sways during a swing, comprising:

a base including an upwardly angled top surface, said top having an opening;

a cover movably mounted on said base having an upwardly angled top surface, said top surface of said cover having an opening aligned with and separated a distance from said opening of said top of said base, said distance of said opening of said cover from said opening of said top of said base being increased as said cover is moved away from said top of said base and decreased as said cover is moved toward said top of said base;

a light source positioned on said base and adapted to emit a light through said openings in said cover and said top, the range of light visible to a golfer through said opening in said cover being increased or decreased as said distance of said opening of said cover from said opening of said top is increased or decreased; and a lens positioned between said base and said cover and aligned with said openings in said cover and said top, said lens having at least two colored strips such that said light is divided into a center beam of light and at least one side beam of light.

* * * * *

UNITED STATES PATENT AND TRADEMARK OFFICE

CERTIFICATE OF CORRECTION

PATENT NO. : 6,612,937 B1
DATED : September 2, 2003
INVENTOR(S) : Michael Whelan It is certified that error appears in the above-identified patent and that said Letters Patent is hereby corrected as shown below:

Column 4,
Line 1, after “film” insert -- . --.
Line 18, replace “Adjustments” with -- Adjustment --.

Column 5,
Line 27, after “color” delete “A”.

Column 6,
Line 65-68, delete “means for indicating”.
Line 66, before “comprises” insert -- lens --.
Line 66, replace “on” with -- between --.
Line 67, before “base” insert -- top of said --.
Line 67, after “base” insert -- and said opening of said cover --.

Signed and Sealed this

Fifteenth Day of June, 2004

JON W. DUDAS
*Acting Director of the United States Patent and Trademark Office*